United States Patent [19]

Villa et al.

[11] 4,372,632

[45] Feb. 8, 1983

[54] SLIDE INTERLOCK AND CABINET STABILIZER

[75] Inventors: Paul Y. Villa, Santa Clara; Alvin D. Day, San Jose, both of Calif.

[73] Assignee: Sperry Corporation, New York, N.Y.

[21] Appl. No.: 230,580

[22] Filed: Feb. 2, 1981

[51] Int. Cl.[3] ..... A47B 88/00; E05B 65/46

[52] U.S. Cl. ..... 312/311; 312/107.5; 312/216; 312/221; 312/333

[58] Field of Search ..... 312/311, 333, 215, 216, 312/220, 221, 222, 107.5, 250, 242; 292/146

[56] References Cited

U.S. PATENT DOCUMENTS

| | | | |
|---|---|---|---|
| 194,415 | 8/1877 | Crippen | 312/333 |
| 732,971 | 7/1903 | Stoeffler | 312/222 |
| 1,280,183 | 10/1918 | Donathan | 312/221 |
| 1,486,094 | 3/1924 | Lehman | 312/107.5 |
| 1,655,516 | 1/1928 | Simpson | 312/242 |
| 2,587,469 | 2/1952 | Herring | 312/21 |
| 3,371,974 | 3/1968 | Vermeersch | 312/221 |
| 4,149,518 | 4/1979 | Schmidt et al. | 312/311 |
| 4,272,138 | 6/1981 | Stark | 312/333 |

*Primary Examiner*—Victor N. Sakran

*Attorney, Agent, or Firm*—Eugene T. Battjer

[57] ABSTRACT

A locking and bracing apparatus, comprising a vertically movable interlock bar and a horizontally movable outrigger-type support brace, is mounted to a cabinet having a drawer. When the brace is in a stored position within the cabinet or in any position intermediate the stored position and a fully extended position, a peg which is on the interlock bar and slidably rides over the brace keeps the interlock bar in a raised position whereby the drawer is locked in a closed position within the cabinet. When the brace is in the fully extended position to support the cabinet from tipping, the peg is disposed in a hole formed in the brace so that the brace is locked in the extended position and the interlock bar is in a lowered position whereby the drawer is unlocked. Thereafter, if the drawer is pulled outward from the cabinet, the interlock bar is blocked by the drawer from being moved from the lowered position so that the brace remains locked in the extended position. When the drawer is returned to the closed position, the interlock bar may be lifted manually to the raised position thereby locking the drawer and unlocking the brace so that it may be returned to the stored position.

3 Claims, 4 Drawing Figures

SLIDE INTERLOCK AND CABINET STABILIZER

BACKGROUND OF THE INVENTION

1. Field of the Invention

This invention relates generally to a locking device for locking a drawer in stored position in a cabinet and to a safety brace for supporting the cabinet from tipping and more specifically to an apparatus having the locking device operatively associated with a movable, outrigger-type safety brace.

2. Description of the Prior Art

Peripheral memory devices such as disk drive systems for computers are typically mounted in a cabinet. In large memory systems having a plurality of cabinets and disk drive systems, the cabinets are usually arranged in rows in accordance with a prescribed equipment layout plan. Each cabinet typically holds several disk drive units in a spaced and vertically stacked array. Each disk drive unit is usually contained in a chassis which is attached to drawer slides mounted in the cabinet. The drawer slides permit the chassis to be extended horizontally from the cabinet so as to expose the interior of the disk drive for servicing. A locking device is often used to prevent accidental or negligent withdrawals of disk drives chasses from the cabinet while the drives are operating. In addition, since disk drives are heavy, an outrigger-type safety brace is frequently used to prevent tipping of the cabinet when one or more chasses are extended out from the cabinet. In an effort to conserve equipment floorspace and prevent accidents, such safety braces are typically movable to storage positions within the cabinets when not needed. Unfortunately, the safety brace is not always used by maintenance personnel when servicing the disk drives. Under such circumstances, disk drive cabinets can tip over and cause injuries to personnel and damage to the drives. Furthermore, the safety braces may be negligently left in the extended position after the chasses have all been pushed back and locked into the cabinet thereby posing a tripping hazard to persons in the equipment area.

SUMMARY OF THE INVENTION

The above mentioned problems of presently available devices for locking disk drive chasses slidably mounted in a cabinet and bracing the cabinet from tipping are overcome by the provision of a new and improved locking and bracing apparatus. Such apparatus comprises a vertical interlock bar slidably mounted to the cabinet and operatively associated with a movable, outrigger-type safety brace. The interlock bar and safety brace are so constructed and arranged that when the interlock bar is held in a raised position, chassis locking pegs on the interlock are disposed in front of the disk drive chasses and serve to prevent (lock) the chasses from being moved from stored positions within the cabinet. The safety brace portion of the present invention is movable between a stowed position for storage within the cabinet and an extended position for preventing cabinet tipping. When the safety brace is in stowed position or any position intermediate the stowed and extended positions, a brace locking peg on the interlock bar slidably overrides the safety brace thereby maintaining the interlock bar in the raised position so that the disk drive chasses remain locked in stored positions within the cabinet. When the safety brace is moved to the extended position, the brace locking peg falls into a hole formed in the safety brace so that the safety brace is locked in extended position and the interlock bar is moved to a lowered position. When the interlock bar is in the lowered position, each of the chassis locking pegs thereon is disposed below the level of the associated disk drive chassis thereby permitting any chassis to be pulled from the cabinet for servicing. If a chassis is pulled from the cabinet, the associated chassis locking peg thereunder is blocked by the chassis from being raised thereby preventing the interlock bar from being raised from the lowered position. This arrangement prevents unlocking of the safety brace whenever any chassis is pulled from the cabinet. When all the chasses are returned to stored positions within the cabinet, the interlock bar can be lifted manually to the raised position so that the chasses are again locked in the cabinet by the chassis locking pegs and the brace locking peg is raised from the hole in safety brace thereby unlocking the safety brace. Thereafter, the safety brace can be moved manually to the stowed position. As soon as the safety brace is moved from the extended position, the brace locking peg again overrides the safety brace for maintaining the interlock bar in the raised position without any continued manual effort.

The above described and other advantages of the present invention will be more fully understood from a reading of the ensuing detailed description of the preferred embodiment given with reference to the appended drawings.

DESCRIPTION OF THE PREFERRED EMBODIMENT

Figure 1:
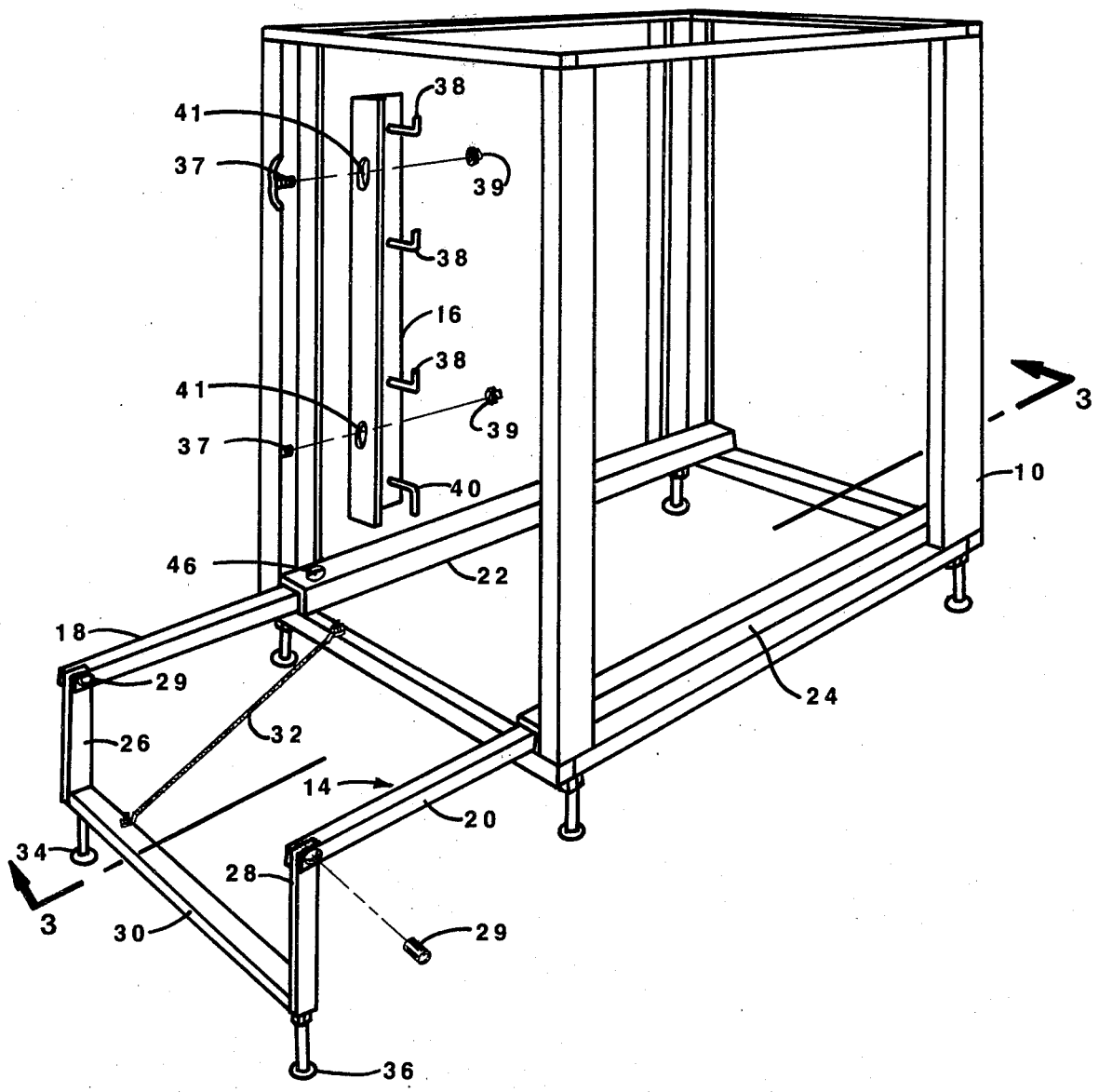
FIG. 1 is a perspective view of a preferred embodiment of the present invention comprising a cabinet frame, an interlock bar and safety brace apparatus.

In FIG. 1 there is depicted a preferred embodiment of the present invention comprising cabinet frame 10, safety brace apparatus 14 and interlock bar 16. Brace apparatus 14 includes horizontal supports 18 and 20 that are slidably mounted for moving horizontally into and out of tubular tracks 22 and 24 respectively, tracks 22 and 24 being fixedly mounted to cabinet frame 10 and having hole 46 formed therethrough, leg supports 26 and 28 which are pivotly connected (by a means to be described in conjunction with FIG. 2) to horizontal supports 18 and 20 respectively using hinge pins 29, lateral arm 30 being rigidly attached to the leg supports so that the horizontal supports and leg supports slide and rotate respectively in unison, rope 32 having one end fixed to cabinet frame 10 and the other end mounted on lateral arm 30, and adjustable levelers 34 and 36 mounted to leg supports 26 and 28 respectively. Cabinet frame 10 has threaded studs 37 thereon which pass through slots 41 formed through interlock bar 16. Conventional self-locking nuts 39 are attached to studs 37 and serve to keep interlock bar 16 slidably mounted against cabinet frame 10. Slots 41 permit vertical movement of the interlock bar between raised and lowered positions. The positions of interlock bar 16 will be discussed further in a later part of this section involving FIGS. 3 and 4. Interlock bar 16 also includes chassis locking pegs 38 and brace locking peg 40 which has one end extending into hole 46 formed in track 22.

Figure 2:
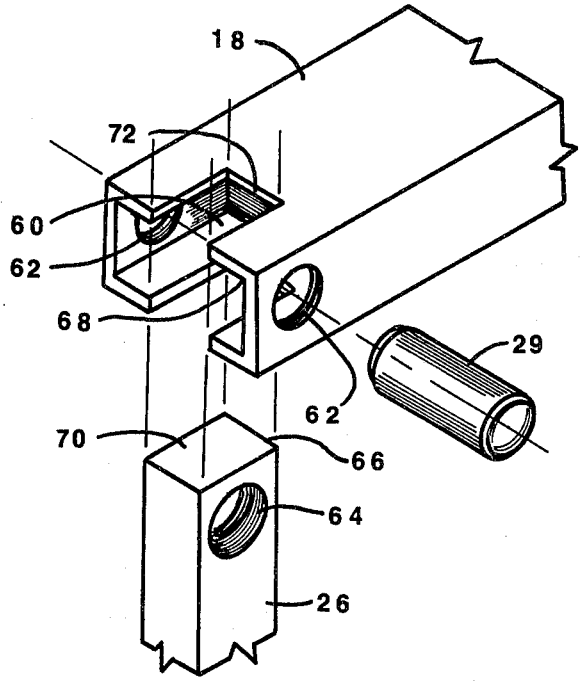
FIG. 2 is an exploded perspective view useful for explaining and understanding the pivoting connection used in the bracing apparatus depicted in FIG. 1.

Horizontal supports 18 and 20 are preferably tubular with rectangular cross sections. The connection between horizontal support 18 and leg support 26 is shown in FIG. 2 and is the same as the connection between horizontal support 20 and leg support 28. With reference to FIG. 2, slot 60 is formed at one end of horizontal support 18 for accommodating one end of leg support 26. Pin 29 is passed through holes 62 and 64 formed through horizontal support 18 and leg support 26 respectively and serves as a pivot for allowing leg support 26 to rotate in a prescribed arc of substantially 90 degrees between upright and horizontal positions with reference to horizontal support 18. As further explanation, if leg support 26 is in the upright position side 66 is nearly in abutment with surface 68, which defines one rear portion of slot 60. Surface 68 serves to prevent leg support 26 rotating substantially past the upright position when moving in a direction towards surface 68 from horizontal to upright position. Furthermore, if leg support 26 is moved from upright to horizontal position side 70 is nearly in abutment with surface 72, which defines a second rear portion of slot 60. Side 70 serves to prevent leg support 26 rotating substantially past the horizontal position.

Figure 3:
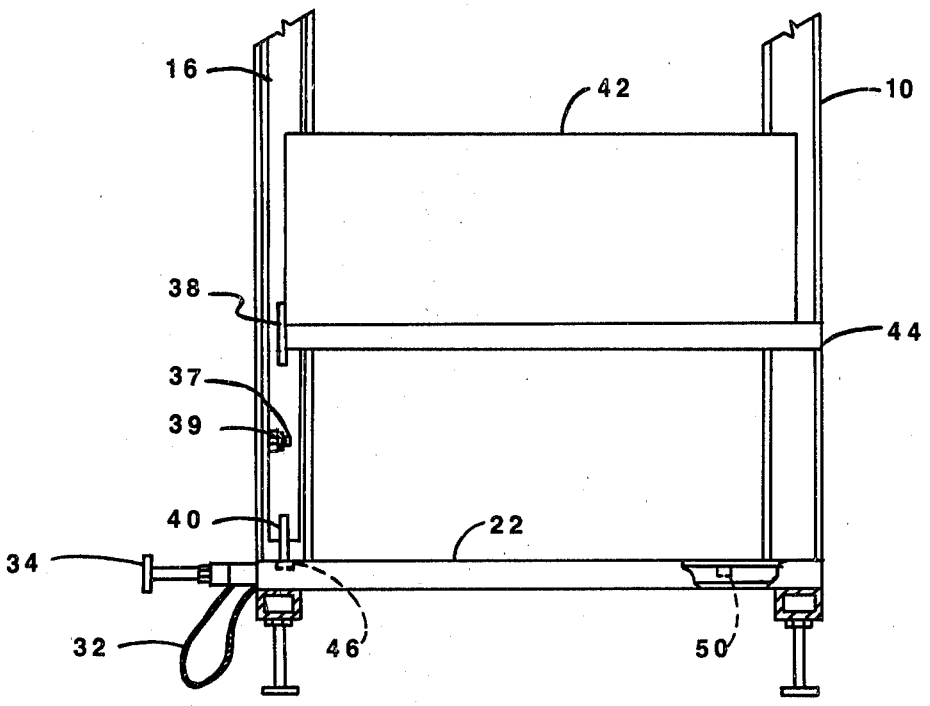
FIG. 3 is a sectional view taken along lines 3—3 of FIG. 1 depicting the interlock bar in a raised position and the bracing apparatus in a stowed position and further showing a chassis in a stored position and drawer type hardware slidably mounting the chassis to the cabinet frame of the present invention.

Horizontal supports 18 and 20 are movable between a stowed position where they are disposed entirely within tubular tracks 22 and 24 respectively for storage in the cabinet frame and a support position where they extend outward from the cabinet frame. When the horizontal supports are in the stowed position, leg supports 26 and 28 are in the horizontal position and also stored within tubular tracks 22 and 24 respectively. When the horizontal supports are in the support position, the leg supports are in the upright position and coact with the horizontal supports to prevent forward tipping of the cabinet frame. In FIG. 3 there is shown interlock bar 16 in the raised (locking) position, a chassis 42 in stored position within cabinet frame 10 and rope 32 loosely stored beneath the cabinet frame. Horizontal support 18 (in FIG. 1) is in stowed position inside track 22 together with the leg support. Chassis 42, which may be a disk drive memory device, is slidably mounted to the cabinet frame by drawer type hardware 44 (well known in the art) so that the chassis may be pulled outwards from the stored position in the cabinet frame for servicing access to the interior of the chassis. Only one chassis and one chassis locking peg are shown for ease of illustration and explanation. Chassis 42 is locked within cabinet frame 10 because interlock bar 16 is in the raised position whereby chassis locking peg 38 blocks the chassis from being pulled outward from the cabinet frame. Brace locking peg 40 on interlock bar 16 fits loosely through hole 46 formed through track 22 and overrides leg support 26 (in FIG. 1) when the leg support is in the horizontal position within track 22. This arrangement keeps interlock bar 16 in the raised position.

Figure 4:
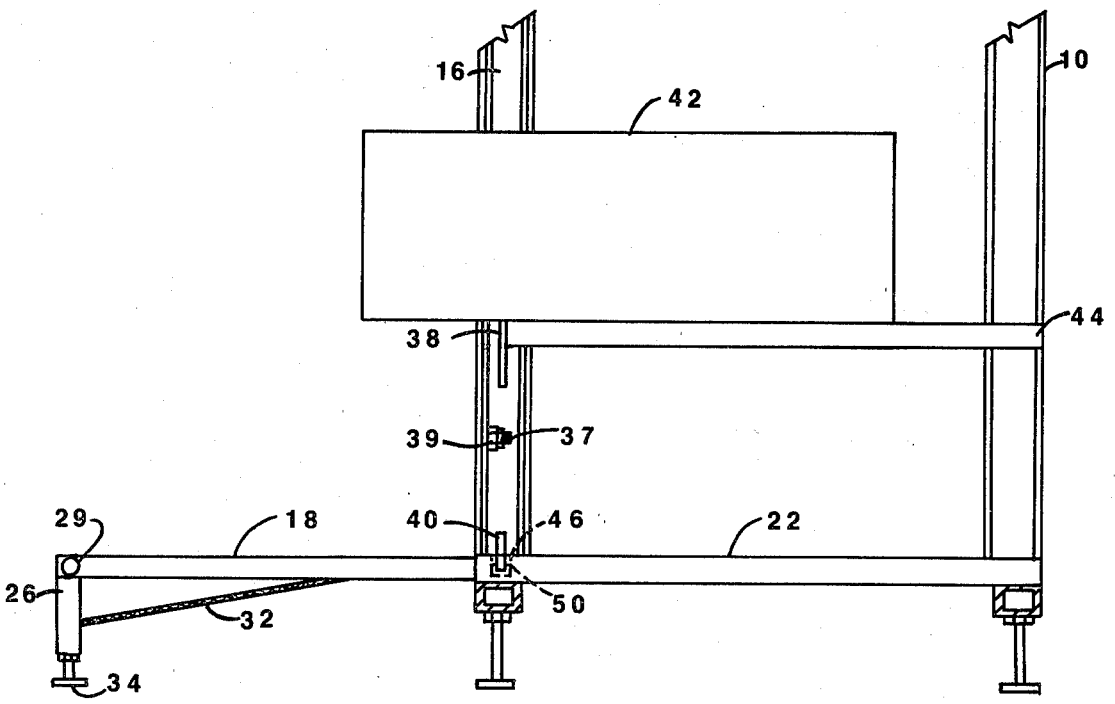
FIG. 4 is a sectional view taken along line 3—3 of FIG. 1 depicting the interlock bar in a lowered position and the bracing apparatus in an extended position for preventing forward tipping of the cabinet frame and further showing the chassis (shown in FIG. 3) pulled to a position outward from the cabinet frame.

With reference to FIGS. 1 and 3, when horizontal supports 18 and 20 are pulled outward from the cabinet frame, brace locking peg 40 slides over leg support 26 and thereafter over horizontal support 18 so that interlock bar 16 is maintained in the raised position thereby keeping chassis 42 locked within the cabinet frame. When horizontal supports 18 and 20 are fully extended to the support position, hole 50 formed in horizontal support 18 coincides with brace locking peg 40 so that the peg falls into the hole thereby locking the horizontal supports in the support position and resulting in interlock bar 16 being moved to the lowered position. FIG. 4 shows interlock bar 16 in the lowered position, horizontal support 18 in the support position and rope 32 tautly stretched. Brace locking peg 40 extends through holes 46 and 50 for locking the horizontal supports in the support position. Since the interlock bar is in the lowered position, chassis locking peg 38 thereon is disposed below the bottom level of chassis 42 and no longer blocks the chassis from being withdrawn from the cabinet. When chassis 42 is pulled to any position outward from the cabinet frame, the chassis blocks peg 38 from being moved upwards so that interlock bar 16 is prevented from being moved from the lowered (locking) position. This arrangement prevents unlocking of the safety brace apparatus whenever chassis 42 is pulled from the cabinet frame for servicing.

With reference to FIGS. 1 through 4, as brace apparatus 14 is pulled from the cabinet frame, leg supports 26 and 28 swing by gravity from the horizontal position to the upright position. It should be recalled that the leg supports rotate in unison, because of lateral arm 30 connected therebetween, to the upright position and are not permitted rotation substantially past the upright position. Accordingly, when the horizontal supports are locked in the support position and rope 32 is tautly stretched, leg supports 26 and 28 are maintained in the upright position and cannot be moved therefrom. Levelers 34 and 36, which are well known in the art, are individually adjustable so that the leg supports each have sufficient length to contact the floor (uponwhich the cabinet frame is resting) when the leg supports are in the upright position. Levelers are useful to accommodate uneven floors or a cabinet frame that has adjustable supports for varying the height between the cabinet frame and the floor.

Finally, after chassis 42 has been returned to the stored position within the cabinet frame, interlock bar 16 may then be lifted manually from the lowered position to the raised position thereby locking chassis 42 in the cabinet frame and unlocking the horizontal supports so that they may be pushed back into the tracks. As hole 50 is moved away from peg 40, the peg again overrides horizontal support 18 thereby maintaining interlock bar 16 in the raised position without continued manual effort. Thereafter, when the horizontal supports are pushed a sufficient distance into the tracks so that rope 32 is slackened enough for permitting the leg supports to be lifted manually to the horizontal position, the leg supports and the portions of the horizontal supports still extending outward from the cabinet frame may be moved into the tracks for storage.

While the invention has been described with reference to a specific embodiment, it will be apparent that improvements and modifications may be made within the purview of the invention without departing from the true spirit and scope thereof as defined in the appended claims.

We claim:

1. A cabinet assembly comprising: a cabinet including a drawer movable between stored and other positions; vertically disposed interlock means slidably mounted to said cabinet and movable between raised and lowered positions; a brace locking peg and a chassis locking peg rigidly affixed to said interlock means; and horizontally disposed brace means slidably mounted to said cabinet, said brace means having a hole formed therein and being movable to an extended position for supporting said cabinet from tipping and to a stowed position for storage within the cabinet;

wherein said cabinet assembly is so constructed and arranged that in the situations where said brace means is at the stowed position or any position intermediate the stowed and extended positions, said brace locking peg overrides the brace means whereby said interlock means is held in said raised position and said chassis locking peg is disposed for locking said drawer in the stored position; where said brace means is moved to the extended position, said brace locking peg falls into said hole of the brace means so that said brace means is locked at the extended position and said interlock means is moved to said lowered position whereby said chassis locking peg is disposed under the drawer and said drawer is unlocked for moving from said stored position; where said drawer is at said other position, said chassis locking peg is blocked by the drawer from being raised thereby preventing said interlock means from moving from said lowered position; and where the drawer is at said stored position and said interlock means is moved back to said raised position whereby said brace locking peg is lifted from said hole, said brace means is unlocked for moving from said extended position and said chassis locking peg is disposed for locking said drawer.

2. The cabinet assembly of claim 1 wherein said brace means includes leg means, horizontal support means which is horizontally disposed and adapted for slidable mounting to said cabinet, and pivot means for connecting said leg means to one end of said horizontal support means; said brace means so constructed and arranged that said horizontal support means with said leg means thereon is movable horizontally between said stowed and extended positions; said leg means is rotatable in a prescribed arc of substantially ninety degrees between level and upright position whenever said brace means is at a position intermediate said stowed and extended positions; and said leg means when in said level position permits said brace means to be moved to said stowed position and when in said upright position coacts with said horizontal support means in the extended position for preventing tipping of said cabinet.

3. The cabinet assembly of claim 2 further including means having one end adapted for mounting to said cabinet and the other end adapted for mounting to said leg means, said means arranged so that whenever said horizontal support means is at said extended position, said means serves to maintain said leg means in said upright position and to prevent said leg means from being rotated towards said level position, and whenever said horizontal support means is at the position intermediate the extended and stowed positions, said means permits said leg means rotation back to said level position for allowing said brace means to be moved to said stowed position.

* * * * *